United States Patent [19]

Phipps et al.

[11] 3,962,990

[45] June 15, 1976

[54] APPARATUS FOR COATING ELONGATE ARTICLES

[75] Inventors: John Alastair Phipps, Farncombe; Morris James Legg, Farnham, both of England

[73] Assignee: Plastic Coatings Limited, Guildford, England

[22] Filed: Nov. 4, 1974

[21] Appl. No.: 520,853

[30] Foreign Application Priority Data

Nov. 29, 1973 United Kingdom ..... 55301/73

[52] U.S. Cl. ..... 118/620; 118/120; 118/404; 427/195; 427/356; 427/358; 427/435

[51] Int. Cl.[2] ..... B05C 5/00

[58] Field of Search ..... 427/189, 195, 185, 356, 427/358, 435; 118/404, 405; 425/455, 218

[56] References Cited

UNITED STATES PATENTS

| | | | |
|---|---|---|---|
| 2,287,826 | 6/1942 | Postlewaite et al. | 118/404 |
| 2,522,364 | 9/1950 | Grana | 118/404 |
| 3,045,640 | 7/1962 | Hill et al. | 118/404 X |
| 3,273,987 | 9/1966 | Marzocchi | 427/358 |
| 3,389,010 | 6/1968 | Burch | 427/195 |
| 3,503,778 | 3/1970 | Corbett et al. | 427/195 |
| 3,669,738 | 6/1972 | Cottis et al. | 427/358 X |
| 3,742,106 | 6/1973 | Price | 427/185 |

*Primary Examiner*—Ralph Husack
*Assistant Examiner*—Shrive P. Beck
*Attorney, Agent, or Firm*—Larson, Taylor and Hinds

[57] ABSTRACT

Apparatus for externally coating an elongate article having a low thermal mass comprises a coating channel, means for supplying coating powder to the coating channel to support and immerse an article, the coating channel having a substantially V-form cross-section with opposing sidewalls which converge in the downstream sense to maintain the required depth of coating powder, means for passing the article through the coating channel to an outlet thereof, means for heating the article before it enters the coating channel, means for vibrating the coating channel, and a conveyor which passes beneath the outlet of the coating channel in a direction parallel to the coating channel wherein the conveyor is arranged to receive the article from the coating channel together with a supporting compacted bed of coating powder in which the article remains immersed.

1 Claim, 2 Drawing Figures

APPARATUS FOR COATING ELONGATE ARTICLES

BACKGROUND OF THE INVENTION

This invention relates to a method and apparatus for coating elongate articles. Although not so restricted the invention is particularly suitable for use in coating thin walled metal tubes or other articles having thin walls.

In our U.S. patent application Ser. No. 490,659, filed July 22, 1974 a method for the coating of tubes is described. It discloses the use of a vibrating coating channel having a compacted body of coating powder therein, the compacted coating powder being used to support, during coating finite lengths of tubing.

Where the elongate articles are of thin walled cross-section the low thermal mass of the articles may prevent efficient coating by the apparatus described in U.S. application Ser. No. 490,659.

It is an object of the present invention to overcome this problem.

SUMMARY OF THE INVENTION

According to one aspect of the present invention there is provided a method of externally coating an elongate article having a low thermal mass, wherein the article is heated and passed through a vibrating coating channel whilst being supported and immersed in a compacted bed of coating powder, characterised in that the article is transferred from the coating channel to a conveyor where the article remains immersed in the coating powder to provide a further coating period.

Preferably the coating channel is of substantially V-form cross-section and the depth of coating powder in the coating channel is maintained by a convergence in the downstream sense of the sidewalls of the coating channel.

Preferably the article is heated before it enters the coating channel.

Preferably the compacted bed of coating powder is further compacted downstream and adjacent an outlet from the coating channel.

According to another aspect of the present invention, apparatus for performing the method set forth above comprises a coating channel, means for supplying coating powder to the coating channel to support and immerse the article, a vibrator for vibrating the coating channel, means for passing the article through the coating channel, and a conveyor for receiving the article from the coating channel together with a supporting compacted bed of coating powder wherein the article remains immersed.

Preferably the coating channel is of substantially V-form cross-section with opposing sidewalls which converge in the downstream sense to maintain the required depth of coating powder.

BRIEF DESCRIPTION OF THE DRAWINGS

By way of example the apparatus will now be described with reference to the accompanying diagrammatic drawings of which.

Figures 1, 2:
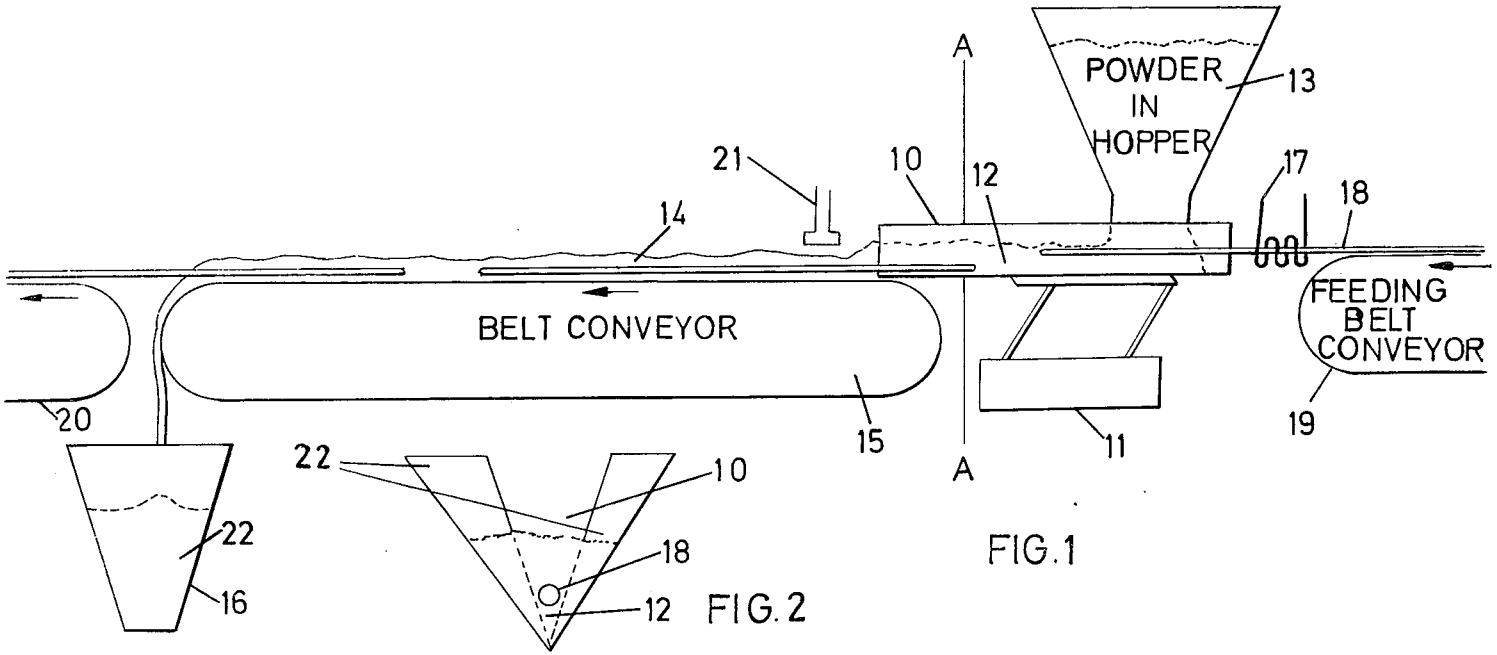
FIG. 1 is a side view of a coating apparatus according to the present invention and, FIG. 2 is a section taken on line A—A of FIG. 1.

Referring to the drawings, a coating channel 10 is provided with sidewalls 22 which converge towards the downstream end of the channel to provide a restrictor effect which maintains the required depth of coating powder 12 in the coating channel 12. The channel 10 is provided with a vibrator 11 which may be an electromagnetic vibrator operating at a frequency of 50 c.p.s., to compact coating powder 12 within the coating channel 10. The features of the coating channel are further described in U.S. application Ser. No. 490,659. The coating channel 10 is provided with an overhead hopper 13 which continually supplies coating powder 12 to the coating channel 10. An article to be coated externally, e.g. a thin walled tube 18, after receiving a coating in the channel 10 leaves the latter at the downstream open end to be carried away on an endless conveyor 15 whilst still immersed in a bed of coating powder 14. Unused coating powder falls from the end of the conveyor 15, is collected by a lower hopper 16, and is returned to the overhead hopper 13 by a conveyor-/elevator (not shown).

A belt conveyor 19 on the inlet side of the coating channel 10 supports the tube 18 of low thermal mass to be coated. A heating coil 17 is used to heat the article 18 immediately prior to entering the coating channel 10. At a suitable distance downstream a further conveyor 20 receives the tube 18 from the conveyor 15 and conveys it to an unloading station.

In operation the tube 18 is automatically transferred to the conveyor 19 which passes the article through the heating coil 17 and onto the coating channel 10. The heated tube 18 is supported against sagging in a body of compacted coating powder 12 in the coating channel 10. The tube 18 passes through the coating channel 10 and into the downstream conveyor 15 whilst still immersed in a bed of escaping powder 14. When the coated article 18 reaches the end of the downstream conveyor 15, excess coating powder falls downwards into the lower hopper 16 and is recycled to the overhead hopper 13. The coated article meanwhile passes to the further conveyor 20 and having had sufficient time to cool may then be removed at an unloading station. Sintering of the coating may be effected as a further stage of the apparatus. The invention is particularly suitable for use in coating tubes whose circumference is less than 6 inches and whose wall thickness is below 0.035 inch. Wires or other thin sections having a low thermal mass are also efficiently coated by this apparatus.

Where complex section articles are to be coated, the escaping powder 14 may be further compacted by a vertically reciprocating device 21 downstream and adjacent the outlet from the channel 10.

What we claim is:

1. Apparatus for externally coating an elongate article having a low thermal mass comprises a coating channel, means for supplying coating powder to the coating channel to support and immerse an article, the coating channel having a substantially V-form cross-section with opposing sidewalls which converge in the downstream sense to maintain the required depth of coating powder, means for passing the article through the coating channel to an outlet thereof, means for heating the article before it enters the coating channel, means for vibrating the coating channel, and a conveyor which passes beneath the outlet of the coating channel in a direction parallel to the coating channel wherein the conveyor is arranged to receive the article from the coating channel together with a supporting compacted bed of coating powder in which the article remains immersed.

* * * * *